US005080365A

United States Patent [19]

Winchell

[11] Patent Number: 5,080,365

[45] Date of Patent: Jan. 14, 1992

[54] GOLF CLUB

[76] Inventor: Frank J. Winchell, 70 Celestial Way #306, Juno Beach, Fla. 33408

[21] Appl. No.: 504,403

[22] Filed: Apr. 3, 1990

[51] Int. Cl.[5] ..... A63B 53/04

[52] U.S. Cl. ..... 273/169; 273/167 C; 273/167 F

[58] Field of Search ..... 273/167 R, 167 A, 167 B, 273/167 C, 167 D, 167 E, 167 F, 167 G, 167 H, 167 J, 167 K, 168, 169

[56] References Cited

U.S. PATENT DOCUMENTS

| | | | |
|---|---|---|---|
| 3,399,898 | 9/1968 | Burkland | 273/167 F |
| 4,010,958 | 3/1977 | Long | 273/167 F |
| 4,138,117 | 2/1979 | Dalton | 273/167 F |
| 4,141,556 | 2/1979 | Paulin | 273/167 F |
| 4,693,478 | 9/1987 | Long | 273/169 |
| 4,872,684 | 10/1989 | Dippel | 273/167 C |
| 4,898,387 | 2/1990 | Finney | 273/167 F |

*Primary Examiner*—Edward M. Coven
*Assistant Examiner*—Raleigh W. Chiu
*Attorney, Agent, or Firm*—Dickinson, Wright, Moon, Van Dusen & Freeman

[57] ABSTRACT

A golf club head characterized by: (1) a longitudinal division of the principal mass, (2) a high polar moment of inertia to mass ratio, (3) a striking surface structure with a first order resonant frequency of at least 2000 cps, (4) nearly equal yaw and pitch polar moments of inertia, (5) symmetry about and positive identification of longitudinal axis and sweet spot, (6) a striking surface which lies well forward of the neutral axes, and (7) a point of application of the stroking forces on the longitudinal axes and forward of the center of gravity.

11 Claims, 3 Drawing Sheets

GOLF CLUB

FIELD OF THE INVENTION

This invention relates to golf clubs and specifically to the optimization of club design through an arrangement of the applied and inertial forces and moments which minimizes the inadvertent displacement errors of the head mass in the course of both the stroke and impact, with the provision for improved alignment of the striking surface, neutral axes, center of mass and center of percussion with the line to the target, thereby assuring more consistent and predictable distance and direction of the ball.

BACKGROUND OF THE INVENTION

Golf is a game of accuracy and repeatability, the objective of the play being to get the ball from a starting point to the bottom of a distant 4¼ inch diameter hole in the fewest number of strokes, and to do so consistently.

While the player is, by far, the largest variable in the process, club design is significant, particularly to the more proficient player, in all of the four basic stages in the ball striking process; i.e., alignment, back stroke, fore stroke and impact.

The distance and direction imparted to the ball are consequent only to the forces and moments produced in the transfer of kinetic energy from the head to the ball in the course of the collision of the two masses. The forces and moments applied by the player through the impact interval are not significant. They are only significant to the process of giving the head mass speed, direction and alignment at the instant prior to impact.

The player, through the shaft, first aligns the striking surface with the target; then, through the shaft, accelerates the head mass in taking it away from the ball, decelerates it to stop it and to change direction, then accelerates it again to bring it back into the ball. In this process of generating the forces and moments to bring about these requisite accelerations, errors by the player are inevitable. The point of impact on the head, the path, position, and attitude of the club head at impact is, therefore, not precisely consistent and predictable.

The forces and moments applied to the shaft inadvertently are reacted by equal and opposite inertial forces and moments of the head mass. The mass and the distribution of the head mass therefore influence the degree of error in the speed, point of impact, path, position, and attitude of the club head at impact, and through impact. Given reasonable mass, length and width, head design is optimized by the prudent distribution of the head mass with relation to the points of application of the stroking and impact forces and moments; i.e., (1) placing as much of the total mass as possible, in essentially equal parts at the extreme ends of the longitudinal dimension; i.e., maximizing both pitch and yaw polar moments of inertia to mass ratio, ($k^2$)—from the relationship $I/m=k^2$, where:

I = polar moment of inertia m = head mass k = radius of gyration;

(2) placing the point of application of the stroking forces such that there is no yaw moment consequent to the stroking process; and (3) identifying the point of impact producing no yaw or pitch moments at impact.

It is my objective, given reasonable overall dimensions, to maximize k, to insure no yaw moment in the stroke and to minimize the yaw and pitch moments at impact.

Preparatory to striking the ball, the player aligns the club head behind the ball with the intention of moving it away and back into that position with the speed to impact the ball with sufficient energy to cause the ball to travel the desired distance in the desired direction. For the ball to move away from the point of impact on a line to the target, the head mass must be moving on the line with the striking surface square with the line and the ball impacted by that point on the striking surface which produces no yaw or pitch moment; i.e., "the sweet spot"; that point on the striking surface where a force normal to the striking surface passes through the center of percussion. The center of percussion is that point within the physical club head where the mass appears to be concentrated. A square hit on the sweet spot results in maximum energy transfer and a ball departure angle square with the striking surface. The loss of distance and direction, consequent to an error in the point of impact, varies directly with the eccentricity of the hit and inversely with the polar moment of inertia. The rate at which distance and direction are affected by eccentricity of impact, bears directly on consistent play. While such errors are small they are real.

Polar moments about both the yaw and pitch axes are important. While prior designs show some apparent attention to yaw inertia; i.e., "heel and toe weighting," there has been no recognizable awareness of the very substantial significance of pitch inertia.

A "miss" to the right or left of the yaw axis results in both distance and direction errors. A miss above or below the pitch axis, of the conventional club, results in a more significant distance error but without directional error.

The longer the putt, for example, the larger the variation in the actual point of impact. At 25 feet an average golfer will experience a variation of the order of plus or minus ½ inch. One putter, typical of putters currently favored by some amateurs and professionals, shows a rapidly changing energy loss with an impact right or left of the center of percussion with a loss at ½ inch of some 10% and a directional error of approximately one degree. An impact error above or below the center of percussion results in a more rapidly changing energy loss, with a loss at ½ inch of approximately 20%.

I have found that these errors, as well as path and alignment errors, can be substantially reduced by:

optimizing the distribution of the head mass, for maximum polar moments of inertia to mass ratio ($k^2$) about both the pitch and yaw axes while maintaining sufficient stiffness of the striking surface;

positioning of the point of application of the stroking forces and moments, with respect to the center of mass, center of percussion and neutral axis of the head, to eliminate the inertial moment arm and to stabilize the head in the stroking process; and the inclusion of a longitudinal member lying on the geometric axis, passing through the center of mass, center of percussion and neutral axis; square with the striking surface and of sufficient length to enhance the alignment process as well as to identify the sweet spot.

In conventional configurations, shown schematically in FIG. 1, the yaw polar moment of inertia of club head 10 is maximized by placing as much of the mass as possible, in equal parts, to the extreme lateral ends, i.e., "heel to toe" weighting of the club head. This results in mass concentrations 12 and 14 interconnected by integral sole and ball-striking flanges 16 and 18, respectively. Concentrating the mass at the heel and toe, however, limits the pitch polar moments and subjects the striking surface to bending.

To achieve the stiffness or resonant frequency required of the striking surface in releasing the energy stored in bending to the ball requires that a significant portion of the club head mass must be placed between the mass concentrations 12 and 14, i.e., in the flanges 16 and 19, thereby limiting the potential polar moment of inertia. In other words, building rigidity into the striking surface in a conventionally designed club by means of a structurally sufficient flange 18 has the undesirable effect of reducing the polar moment of inertia.

If however: (1) the mass is split longitudinally, as in FIGS. 2–10, the connecting member between the mass concentrations is in compression rather than bending. Therefore, the connecting member mass may be reduced to a minimum and moved to the ends of the configuration; thus (2) enabling a higher polar moment of inertia to mass ratio ($k^2$), with the consequent reduction of stroke and impact errors, but (3) without sacrificing bending stiffness.

(4) Positioning the mass longitudinally substantially increases pitch and yaw polar moments of inertia such that both are maximum and essentially equal.

(5) My arrangement allows for the symmetry required for (a) the positive identification of the center of percussion. Moreover, (b) the longitudinal member facilitates simplification of the alignment process: at address the axis of the longitudinal member is centered behind the ball and on the line through the target. On the backstroke the head is taken away and brought back on the extension of that same axis. The axis and line to the target are coincident in both address and stroke. Finally, (c) the center of percussion, center of mass and intersection of neutral axes are essentially coincident, lying on the longitudinal axis; square with and behind the striking surface. All attribute accuracy in alignment at address and in the course of the stroke.

(6) My arrangement results in the striking surface being well ahead of the point at which the pitch and yaw neutral axes intersect the longitudinal axis. Accordingly, when the point of impact is displaced from the sweet spot, the yaw moment produced at impact is in a direction to reduce the effect of the path and/or attitude errors inadvertent to the fore stroke.

(7) The forward mass accommodates the attachment of the shaft such that (a) the effective point of application of stroking forces lies on the longitudinal axis so that there is no yaw or pitch moment arm on either the back or fore strokes; and (b) the fore and aft location of the stroking force may be positioned forward of the center of gravity for stability in the fore stroke.

These features are optimized in a simple "mallet" configuration (FIG. 2) wherein the fore and aft masses 20, 22 are connected by a thin wall tube 24; the masses 20, 22 being essentially discs or cylinders of high density, high modulus material such as steel, brass, tungsten, and the like.

The rules of golf, however, as set down by the USGA, require that the length (width) of the striking surface be greater than the longitudinal dimension; thus eliminating the simplest, most accurate, most efficient club configuration. The USGA's stated purpose is not to reduce scores, but, rather, to preserve the game of golf. Nevertheless, there are basic configurations of the head mass which can and do comply with USGA rules while achieving the physical properties of the simple mallet arrangement of FIG. 2. For example, the "T" mallet having an extended head as shown in FIG. 3 and the triangle shown in FIG. 4 comply with USGA rules. I do not wish to be understood as eliminating the embodiment of FIG. 2 from the protection of my patent because of the current USGA rules; such rules are subject to change.

DISCUSSION OF THE PRIOR ART

U.S. Pat. No. 4,010,958 to Long discloses a putter having a square club head with the principal mass disposed at the extreme corners, thus providing for large polar moments of inertia (1), (2) and (4). The stroking forces are directed at the center of gravity, such that there is no inertial moment arm, the head mass is neutral on both the fore and back strokes (7). While not stated, the striking surface on all but FIG. 3 of Long are well ahead of the neutral axis (6). The 12 configuration includes a longitudinal member apparently not intended to aid in alignment since it is short and not well defined. In the proportions shown the striking surface would appear to lack bending stiffness. Points short of optimum appear to be bending stiffness of the striking surface (3) and length and prominence of the longitudinal member for alignment (5). The described area of the square and circular configurations is impractically large and awkward in appearance.

U.S. Pat. No. 4,141,566 to Paulin discloses a putter with a triangular head having a sighting means in the form of a groove formed in a longitudinal rib which marks the center of percussion of the club face and two shorter grooves on a top edge of the club face, one located on either side of the long groove a distance away from the center of percussion corresponding to the radius of a golf ball. The principal objective of the design appears to be improved alignment. The Paulin putter embodies only point (5*a*) of the above features; the identification member is short. The mass is centrally distributed and the overall dimensions somewhat wider than the diameter of a golf ball. The pitch and polar moments of inertia, therefore are substantially less than conventional. The applied forces and moments are effected behind and outboard of the center of the mass. The effect is to create a small rotating moment on the fore and aft strokes and a small degree of instability on the fore stroke. The striking surface is only slightly forward the neutral axis.

U.S. Pat. No. 4,138,117 to Dalton discloses a putter having a elongated longitudinal body perpendicular to a flat, planar striking surface. The objective of the design appears to be improved alignment and reduced stroking and impact errors. The arrangement does not address the need for an optimized polar moment of inertia to mass ratio or the stiffness of the striking surface. The applied forces are positioned such that the head mass is neutral on the back and fore strokes. The claim for the effect of the position of the applied forces in the impact interval are without merit; as is the claim for the pendulum effect attributed to the vertical axis of the shaft attachment. The center of percussion of the striking surface is evidenced by the position of the longitudinal members and in one configuration a line over the axis of the longitudinal member.

SUMMARY OF THE INVENTION

My invention is a golf club head, especially suitable for use as a putter but not limited thereto, which embodies an arrangement of the applied and inertial forces and moments so as to minimize the inadvertent displacement errors of the head mass in the course of both the stroke and impact, with the provision for improved alignment of the striking surface, center of mass, neutral axis and center of percussion with the line to the target, thereby assuring more consistent and predictable carry and direction of the ball.

Specifically, I disclose a club head design characterized in that: (1) the mass is split longitudinally so that the connecting structure is in compression rather than bending; (2) a higher polar moment of inertia to mass ratio for the reduction of stroke and impact error; (3) a first order bending resonant frequency of the striking surface of at least 2000 cps for the efficient transfer of energy to the ball; and (4) pitch and yaw polar moments of inertia that are maximum and essentially equal. My design further provides for (5) symmetry about a long longitudinal axis for (a) the identification of the sweet spot, (b) alignment of symmetrical axis with the line to the target, and (c) alignment of the sweet spot, center of mass and neutral axis on the symmetrical axis, square and directly behind the striking surface; all for accuracy in address and stroke.

My design is further characterized in that (6) the striking surface is well forward of the essential intersection of the neutral axes for the reduction of the effect of head path and attitude errors inadvertent in the force stroke; and (7) the forward mass accommodates the attachment of a shaft such that (a) the point of application of the stroking forces lies on the longitudinal axis so that there is no yaw or pitch moment arm on either the back or fore strokes and (b) the point of application of the stroking force is positioned forward of the center of gravity for stability in the fore stroke.

BRIEF DESCRIPTION OF THE DRAWING

FIG. 10 is a front view of the FIG. 3 embodiment showing the shape of the sole of the striking surface flange.

DETAILED DESCRIPTION OF ILLUSTRATIVE EMBODIMENTS

Figure 1:
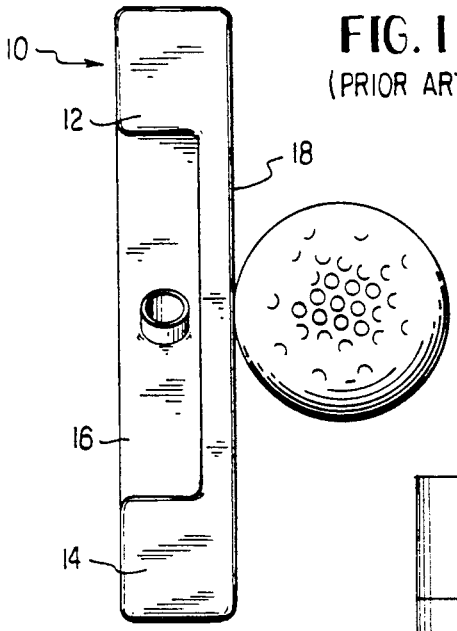
FIG. 1 (PRIOR ART)
FIG. 1 is schematic plan view of a conventional prior art heel-and-toe-weighted putter.
Figure 2:
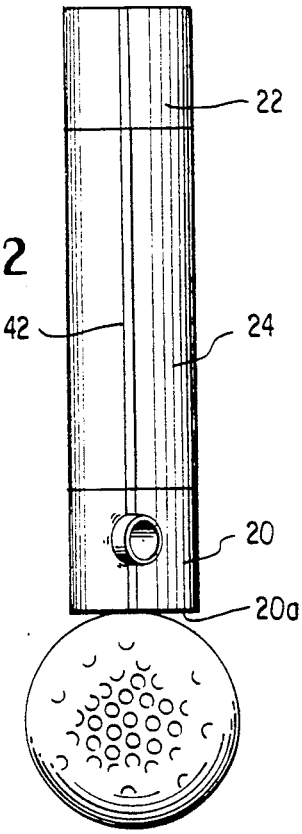
FIG. 2 is a schematic plan view of the simplest embodiment of the principles of my invention.

Properties summarized above are achieved as follows:

FIG. 2 referred to earlier, is the simplest of my arrangements. The principal masses 20 and 22 are concentrated at the extreme ends of the longitudinal axis. The striking surface, the forward face of mass 20, is shown directly behind the ball and is structurally supported by a longitudinal member 24, a central structure connecting the masses 20 and 22 and having a raised sight line 42, square with the striking surface 20*a*. The width of the striking surface for a putter is preferably about the diameter of the ball, e.g., about one and one-half inches, while that for the other clubs is about two and one-half inches. Line 42 may also be defined by a depression or a surface marking.

The masses 20 and 22 are cast or otherwise formed of high density material such as steel, brass, lead or tungsten. The mass of the central structure 24, is minimum.

Figure 3:
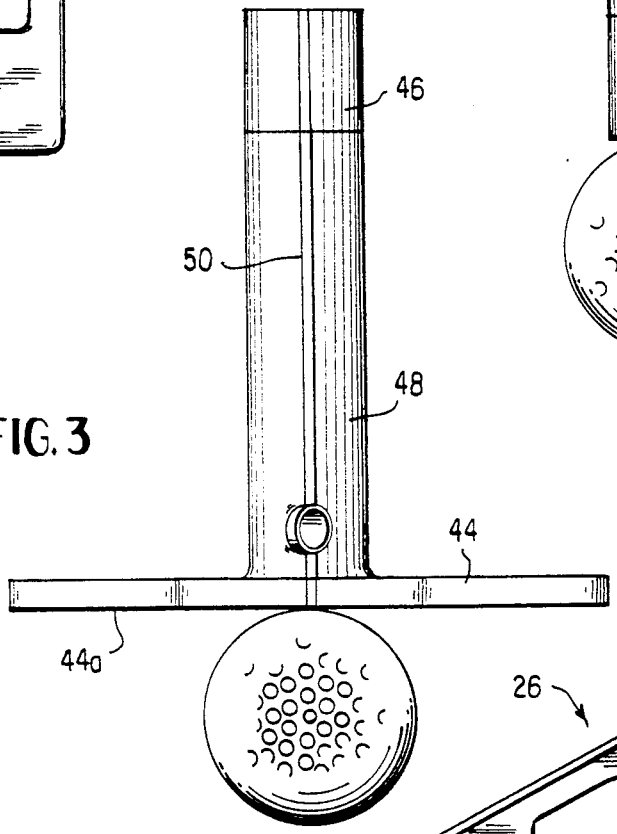
FIG. 3 is a schematic plan view of another embodiment of my invention using a T-shaped configuration.

FIG. 3 is the same as FIG. 2 except that the mass 44 and striking surface 44*a* are widened to comply with the USGA requirement that the lateral dimension of the striking surface be larger than the over all longitudinal dimension.

The principal masses 44 and 46 are cast or otherwise formed of high density material such as steel, brass, lead or tungsten. The mass of the central structure 48 is minimum and exhibits raised (or depressed) sight line 50.

Alternative constructions for FIGS. 2 and 3 are given by way of example: (a) a casting wherein the principal masses are connected by a closed thin wall hollow central structure, with a raised or impressed central line on top square with the striking surface; (b) an open casting wherein the principal masses are connected by an open central structure of sufficient section to insure essential stiffness; or (c) a fabrication of high density end masses cast or otherwise formed and suitably fastened to a cast or molded, solid, hollow or ribbed low density central structure.

Figure 4:
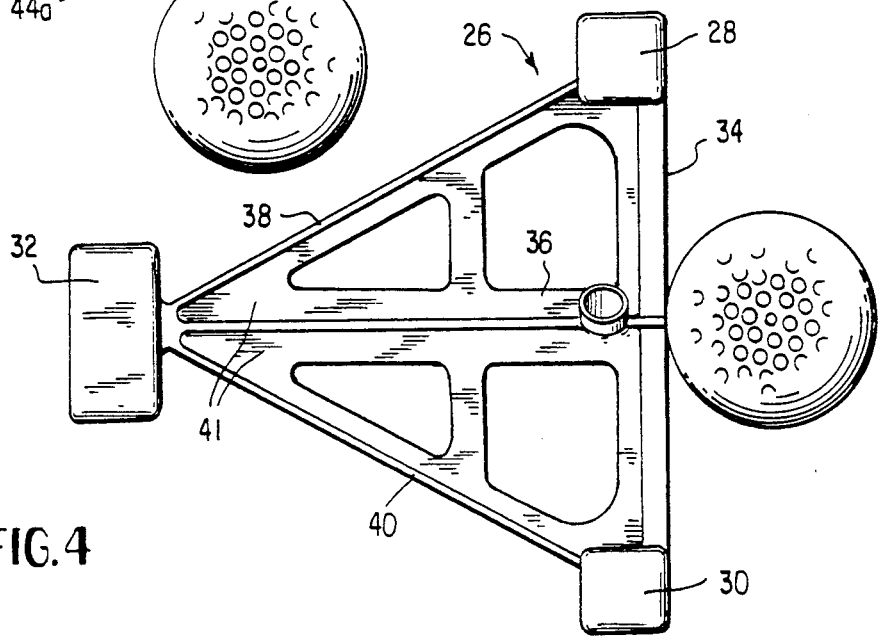
FIG. 4 is a schematic plan view of another embodiment of my invention using an essentially triangular configuration.

FIG. 4 shows a club head 26 wherein the principal masses 28, 30 and 32 are concentrated at the corners of an isosceles triangle. The striking surface flange 34 is shown directly behind the ball and is structurally supported by central longitudinal member 36 and diagonal members 38 and 40. Longitudinal member 36 is square with the striking surface flange 34. A thin web 41 may be cast or otherwise formed between the ribs and may be lightened by holes as shown. Alternatively the webbed areas may be open.

The masses 28, 30, and 32 are cast or otherwise formed of high density material such as steel, brass, lead or tungsten. The masses of the striking surface 34, longitudinal and diagonal members 36, 38 and 40, i.e., the central structure, are minimum.

Alternative constructions are given by way of example: (a) a casting wherein the corner masses are connected by a closed thin wall hollow central structure consisting of a striking surface, triangular top and bottom plates closed on both sides with a raised or impressed central line of the top plate square with the striking surface; (b) an open casting wherein the corner masses are connected by an open central structure consisting of a striking surface, longitudinal and diagonal members of sufficient section to insure essential stiffness; or (c) a fabrication of high density corner masses cast or otherwise formed and suitably fastened to a cast or molded, solid, hollow or ribbed low density central structure.

Figure 5:
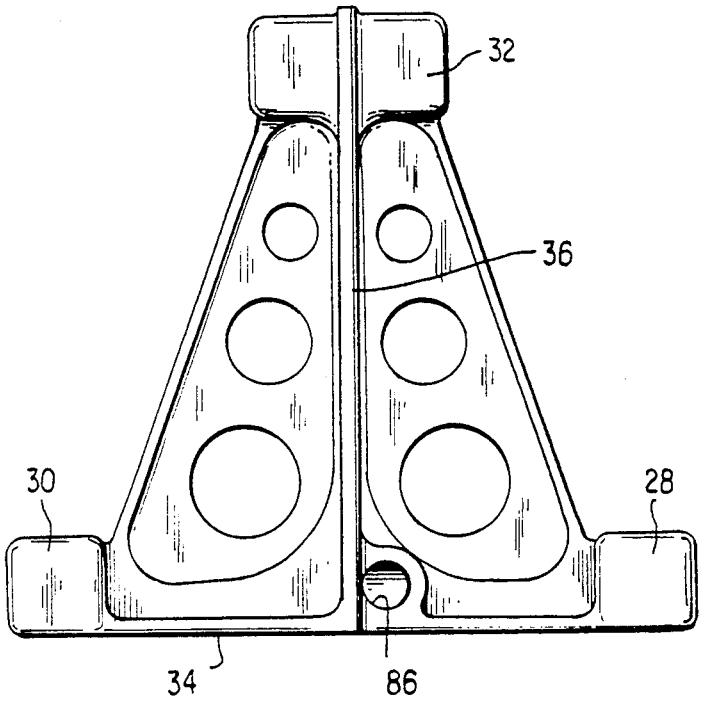
FIG. 5 is a plan view of the embodiment of FIG. 4 with additional structural detail.
Figure 6:
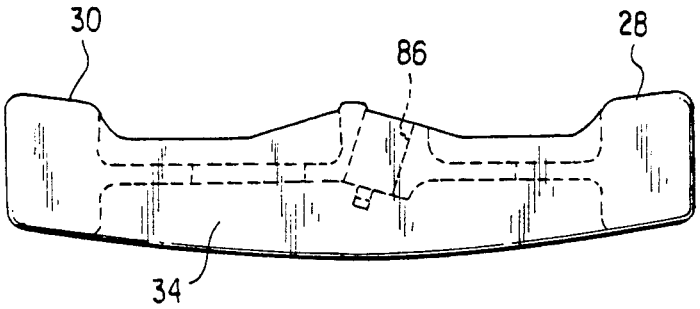
FIG. 6 is an end view of FIG. 5 embodiment.
Figure 7:
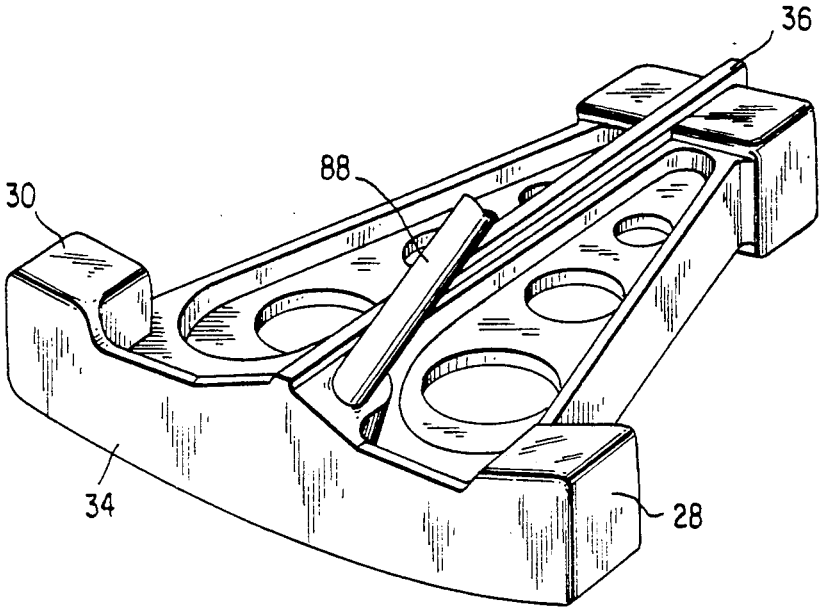
FIG. 7 is a isometric view of the FIG. 5 embodiment.

FIGS. 5–7 illustrate in detail alternative constructions (b) for the club head diagramed in FIG. 4, i.e. an open casting wherein the corner masses are connected by an open central structure consisting of a striking surface, longitudinal and diagonal members of sufficient section to insure essential stiffness. Shaft 88 is attached at point 86 as shown; remaining components are numbered according to FIG. 4.

Figure 8:
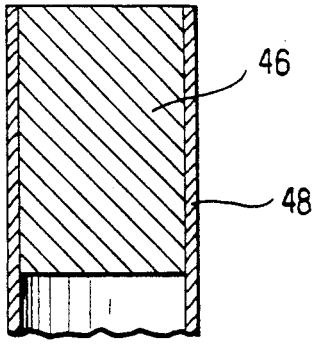
FIGS. 8, 9 and 10 show details of the embodiment of FIG. 3.
Figure 9:
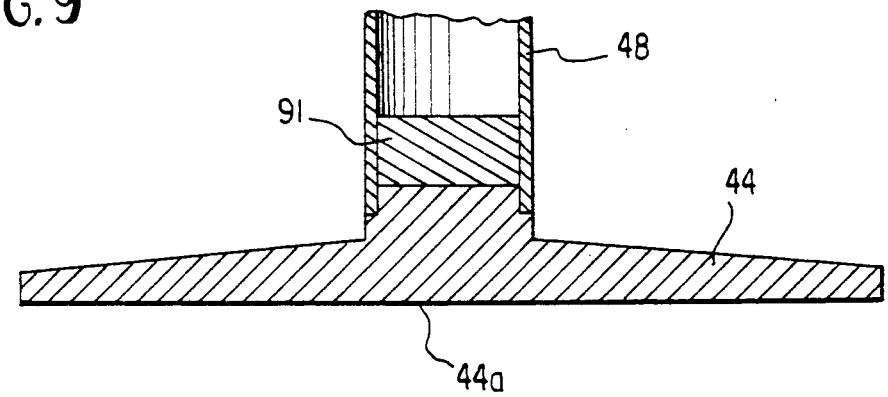
Figure 10:
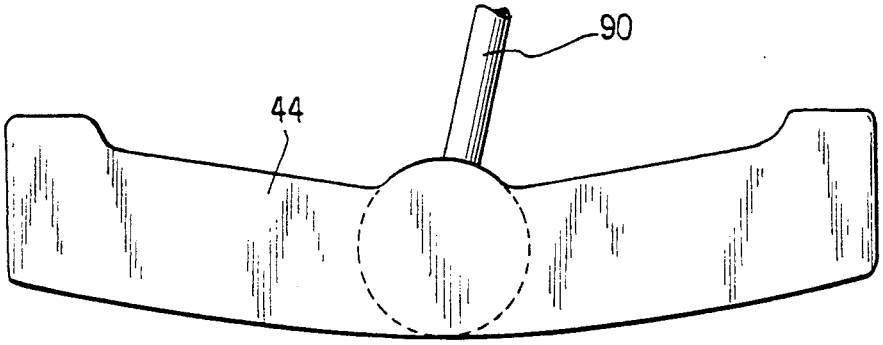

FIGS. 8–10 illustrate in some detail embodiment (c) of three disclosures for the construction of the club head diagramed in FIG. 3, i.e., fabrication of high density end masses cast or otherwise formed and suitably fastened to a cast or molded, solid, hollow or ribbed low density central structure. Shaft 90 is suitably attached as shown. Striking surface mass 44 is bonded otherwise secured to anchor plug 90 and central structure 48. The remaining components are numbered according to FIG. 3. Note the radiussed sole evident in FIG. 10.

Polar moments of inertia of 0.01 in lb $sec^2$, and a k of 1.94, have been achieved for designs illustrated in FIGS. 2-10 for putter heads of 1 lb, (m=0.0026 lb. $sec^2$/in.), and overall lengths ranging from 3.5 to 5 inches. Putter weights generally range from about 0.6 lb. to 2 lbs., and I believe the optimum is about 1 lb. In accordance with the invention, the polar moment of inertia for a putter should be at least 0.006 in. lb. $sec^2$.

The putter is generally the heaviest club in the golfer's bag, ranging from 0.5 pounds to 2.0 pounds. A typical driver, at about 0.44 pounds is generally the lightest club in the bag. A 1 iron is the lightest of the iron clubs, at about 0.52 pounds, and the shorter irons, i.e. the 2 through 9 iron and the wedge, are progressively heavier by increments of approximately 0.02 pounds, with the 9 iron and pitching wedge weighing about 0.65 pounds.

The yaw polar moment of inertia of tour putters (for example, that known as a "bulls eye") ranges from 0.002 to 0.006 in. lb. $sec.^2$. That of the typical driver is about 0.0013, the 1 iron 0.001, and the 9 iron slightly more. The pitch polar moment of inertia of a conventional club head is substantially less than the yaw polar moment of inertia.

Splitting the mass of the head longitudinally in accordance with the invention, rather than laterally as in the prior art, facilitates the most efficient utilization of materials. In other words, a larger ratio I/m can be achieved per inch of length of the club head with essentially equal pitch and yaw polar moments of inertia. For similar overall dimensions, the yaw polar moments in accordance with the invention are two to five times those of conventional putters and two to four times those of the remaining clubs. The comparative gains in pitch polar moments of inertia consequent to the longitudinal versus lateral split of the masses are even higher.

In each of my embodiments shown in the drawings, the yaw neutral axis runs orthogonal to the plane of the paper in plan view; e.g., FIGS. 2, 3, 4, and 5, and directly through the longitudinal axis of symmetry which is parallel to sight lines 42 and 50 and longitudinal member 36. The pitch axis is orthogonal to the yaw axis, lies in the plane of the paper in the plan view, and runs parallel to the striking surface. The yaw and pitch neutral axes essentially intersect the center of mass and the geometric center of the head and lie on the longitudinal axis of symmetry.

The "sweet spot" is generally considered to be located at the intersection of a vertical plane containing the yaw neutral axis, a horizontal plane containing the pitch neutral axis, and the plane of the striking surface.

Modifications within the scope of the appended claims will be apparent to those of skill in the art.

I claim:

1. A golf club head comprising:

a rigid body having a mass, a striking surface, a yaw neutral axis which is generally vertical when said striking surface is addressing a ball and a pitch neutral axis which is generally horizontal when said striking surface is addressing a ball, said body comprising longitudinally spaced concentrations of said mass, a connecting structure between said concentrations, and means for receiving an attached shaft, and wherein:

said striking surface is well forward of said pitch and yaw neutral axes and the center of mass of said body, said pitch and yaw neutral axes essentially intersect said center of mass, the geometric center of said body, and the longitudinal axis of said body, the effective point of application of propelling forces from said shaft lies on said longitudinal axis forward of said center of mass, and said mass concentrations are so distributed that yaw and pitch polar moments of inertia are approximately equal.

2. A golf club head according to claim 1 wherein said striking surface is planar and extends perpendicularly to said longitudinal axis.

3. A golf club head according to claim 2 wherein said striking surface is of such a stiffness to provide a first order bending resonance of about 2000 cycles per second.

4. A golf club head according to claim 3 wherein the mass is distributed in first and second mass concentrations and one of said mass concentrations provides a striking surface.

5. A golf club head according to claim 3 wherein said mass is distributed in three mass concentrations, each of said mass concentrations being located at a respective corner of an isosceles triangle.

6. A golf club shaped as a putter and having a head according to claim 3 and wherein said striking surface is about two inches forward of the essential intersection of said pitch and yaw neutral axes and said center of mass.

7. A golf club shaped as a putter and having a head according to claim 3 and wherein said polar moments of inertia are at least 0.006 inch pound $second^2$.

8. A golf club head according to claim 7 wherein the overall longitudinal dimension is 3.5 to 5 inches, the mass is about 0.0026 pound $sec.^2$/inch, the radius of gyration about the pitch and yaw neutral axes is about 1.95 inches, and the pitch and yaw polar moments of inertia are approximately 0.01 inch pound $second^2$.

9. A golf club shaped as a wood or iron and having a head according to claim 3 and wherein said pitch and yaw polar moments of inertia are at least 0.002 inch pound $second^2$.

10. A golf club shaped as a putter and having a head according to any one of claims 1 through 5.

11. A golf club shaped as a wood or an iron and having a head according to any one of claims 1 through 5.

* * * * *